US011566306B2

(12) United States Patent
Lee et al.

(10) Patent No.: US 11,566,306 B2
(45) Date of Patent: Jan. 31, 2023

(54) HIGH-STRENGTH MEDIUM MANGANESE STEEL FOR WARM STAMPING AND METHOD FOR MANUFACTURING SAME

(71) Applicant: INDUSTRY-ACADEMIC COOPERATION FOUNDATION, YONSEI UNIVERSITY, Seoul (KR)

(72) Inventors: Young-Kook Lee, Seoul (KR); Jeongho Han, Incheon (KR); Jae-Hoon Nam, Seoul (KR)

(73) Assignee: INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 300 days.

(21) Appl. No.: 16/760,263

(22) PCT Filed: Dec. 22, 2017

(86) PCT No.: PCT/KR2017/015341

§ 371 (c)(1),
(2) Date: Apr. 29, 2020

(87) PCT Pub. No.: WO2018/124654

PCT Pub. Date: Jul. 5, 2018

(65) Prior Publication Data

US 2020/0354822 A1 Nov. 12, 2020

(30) Foreign Application Priority Data

Dec. 28, 2016 (KR) ..... 10-2016-0180900
Dec. 21, 2017 (KR) ..... 10-2017-0177216

(51) Int. Cl.
*C22C 38/04* (2006.01)
*B21D 22/02* (2006.01)
(Continued)

(52) U.S. Cl.
CPC ..... *C22C 38/04* (2013.01); *B21D 22/022* (2013.01); *C21D 8/0226* (2013.01);
(Continued)

(58) Field of Classification Search
CPC ..... B21D 22/022; C21D 2211/002; C21D 2211/005; C21D 2211/008; C21D 8/0226; C22C 38/02; C22C 38/04
(Continued)

(56) References Cited

U.S. PATENT DOCUMENTS 10,570,493 B2 * 2/2020 Kim ..... C22C 21/08
2007/0163679 A1 * 7/2007 Fujisawa ..... C22C 38/58 148/325

(Continued)

FOREIGN PATENT DOCUMENTS

CN 104498821 4/2015
CN 106086653 11/2016

(Continued)

OTHER PUBLICATIONS

KIPO, PCT Search Report & Written Opinion of PCT/KR2017/015341 dated Apr. 10, 2018.

*Primary Examiner* — Jie Yang
(74) *Attorney, Agent, or Firm* — Lex IP Meister, PLLC

(57) ABSTRACT

The present invention relates to high-strength medium manganese steel for warm stamping, which contains 3-10 wt % of manganese (Mn), 0.05-0.3 wt % of carbon (C), and 0.1-1.0 wt % of silicon (Si) as components thereof, with the balance being iron (Fe) and unavoidably contained impurities. The present invention performs heat treatment at the low austenitizing temperature of medium manganese steel, and thus has the effect of reducing the high thermal energy consumption of the prior art hot stamping process. Furthermore, the present invention does not require an additional
(Continued)

temperature process, and can obtain high strength by only slow cooling such as air cooling outside a mold without performing cooling at high rate inside the mold, and thus has the effects of simplifying a process and improving manufacturing efficiency.

7 Claims, 10 Drawing Sheets

(51) Int. Cl.

| | |
|---|---|
| ***C21D 8/02*** | (2006.01) |
| ***C21D 9/46*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/18*** | (2006.01) |

(52) U.S. Cl.
CPC ..... *C21D 8/0236* (2013.01); *C21D 8/0273* (2013.01); *C21D 9/46* (2013.01); *C22C 38/02* (2013.01); *C22C 38/06* (2013.01); *C22C 38/08* (2013.01); *C22C 38/12* (2013.01); *C22C 38/14* (2013.01); *C22C 38/18* (2013.01); *C21D 2211/002* (2013.01); *C21D 2211/005* (2013.01); *C21D 2211/008* (2013.01)

(58) Field of Classification Search
USPC ..... 420/127
See application file for complete search history.

(56) References Cited

U.S. PATENT DOCUMENTS

| | | | | |
|---|---|---|---|---|
| 2008/0286603 | A1* | 11/2008 | Oh | C22C 38/06 428/684 |
| 2014/0205488 | A1 | 7/2014 | Jun et al. | |
| 2014/0227555 | A1* | 8/2014 | Kawata | B21B 1/26 428/659 |
| 2014/0308156 | A1* | 10/2014 | Oh | C23C 2/02 420/73 |

FOREIGN PATENT DOCUMENTS

| | | |
|---|---|---|
| JP | 60-238419 | 11/1985 |
| KR | 10-2013-0050138 | 5/2013 |
| KR | 10-2014-0085225 | 7/2014 |
| KR | 10-1677398 | 11/2016 |

* cited by examiner

HIGH-STRENGTH MEDIUM MANGANESE STEEL FOR WARM STAMPING AND METHOD FOR MANUFACTURING SAME

TECHNICAL FIELD

The present invention relates to high-strength medium manganese steel. More specifically, the present invention relates to high-strength medium manganese steel for warm stamping and a method for manufacturing the same.

BACKGROUND ART

Recently, as environmental problems such as air pollution have emerged, many methods have been proposed to increase the fuel efficiency of automobiles. In particular, as reductions in the weights of automobiles have emerged as an important part, there are required high-strength steel sheets having not only high formability but also high strength.

Furthermore, since automobile parts such as bumper reinforcement materials or shock absorbers inside doors are parts directly related to passenger safety, ultra-high strength steel sheets having a tensile strength of 980 MPa or more are used, and must have not only high strength but also high elongation. As the rate at which such parts also employ high-strength steel increases, research on the commercialization of high-strength steel is increasing.

In response to these social demands, research has been conducted on methods for easily forming high-strength steel. As such a prior art, there is a hot stamping process proposed in Korean Patent No. 10-0765723. This prior art proposes a manufacturing method that obtains ultra-high strength cold-rolled steel sheet as a final product by performing heat treatment and press forming in a high-temperature austenite single-phase region and then performing rapid cooling using a mold.

However, the prior art hot stamping process poses several problems. First, a problem arises in that thermal energy consumption is excessive due to forming at a high temperature of 900° C., or higher. Next, boron-added steel cannot obtain a hard martensite structure without rapid cooling after forming. Accordingly, although the forming has been terminated, water is poured into the mold, so that the specimen is cooled at high rate while being maintained inside the mold. This causes problems in that the productivity of the process is reduced and also the surface of the mold is repeatedly heated and cooled, thereby reducing the lifespan of the mold due to thermal fatigue.

As a prior art for mitigating this problem, there is Korean Patent Application Publication No. 10-2013-0050138. This prior art discloses a warm press process, including performing heating to a dual-phase temperature range of $Ac_1$-$Ac_3$, and maintaining the temperature and performing forming after the heating. However, due to the low forming temperature of the dual-phase region, a problem arises in that the physical properties of a final product cannot reach physical properties equivalent to those of the prior art hot-stamped steel. Furthermore, although yield strength is an important property of automobile body members, it is not addressed in this prior art. Therefore, this prior art is considered to have limitations as an alternative process to hot stamping.

PRIOR ART DOCUMENTS

Patent Documents (Patent document 1) (Document 1) Korean Patent No. 10-0765723 (published on Oct. 2, 2007)

(Patent document 2) (Document 2) Korean Patent Application Publication No. 10-2013-0050138 (published on May 15, 2013)

DISCLOSURE

Technical Problem

High-strength medium manganese steel for warm stamping and a method for manufacturing the same according to the present invention have the following objects:

A first object is to reduce high forming temperature, which is a disadvantage of the prior art boron-added steel for hot stamping.

A second object is to propose the composition and contents of components of medium manganese steel added with a trace alloying element of a new iron-based alloy for warm stamping which simplifies processes.

A second object is to perform slow cooling in the air outside a mold rather than performing cooling inside the mold, after molding.

The objects of the present invention are not limited to the objects mentioned above, and other objects not mentioned will be clearly understood by those skilled in the art from the following description.

Technical Solution

It is preferable that high-strength medium manganese steel for warm stamping according to the present invention contains 3-10 wt % of manganese (Mn), 0.05-0.3 wt % of carbon (C), and 0.1-1.0 wt % of silicon (Si) as components thereof, with the balance being iron (Fe) and unavoidably contained impurities.

In the high-strength medium manganese steel according to the present invention, it is preferable that the medium manganese steel further contains 0.001-0.1 wt % of niobium (Nb).

In the high-strength medium manganese steel according to the present invention, it is preferable that the medium manganese steel further contains 0.001-5.0 wt % of aluminum (Al).

In the high-strength medium manganese steel according to the present invention, it is preferable that the medium manganese steel further contains 0.001-2.0 wt % of one or more selected from the group consisting of chromium (Cr), molybdenum (Mo), nickel (Ni), and titanium (Ti).

It is preferable that a high-strength medium manganese steel forming member for warm stamping according to the present invention has a composition containing 3-10 wt % of manganese (Mn), 0.05-0.3 wt % of carbon (C), and 0.1-1.0 wt % of silicon (Si) as components thereof, with a balance being iron (Fe) and unavoidable impurities, or a composition further containing 0.001-0.1 wt % of niobium (Nb) as an additional component thereof in addition to the former composition, after hot rolling, a final microstructure includes two phases of tempered martensite and bainite or three phases of tempered martensite, bainite and ferrite, and, in the case of the three phases, the volume fraction of the ferrite is 10% or less (not including 0%).

It is preferable that a high-strength medium manganese steel forming member for warm stamping according to the present invention has a composition containing 3-10 wt % of manganese (Mn), 0.05-0.3 wt % of carbon (C), and 0.1-1.0 wt % of silicon (Si) as components thereof, with a balance being iron (Fe) and unavoidable impurities, or a composition further containing 0.001-0.1 wt % of niobium (Nb) as an additional component thereof in addition to the former composition, and, after austenitizing in a first temperature span from a temperature $T_{50}$, at which a ratio between ferrite and austenite becomes 1:1 in an $Ac_1$-$Ac_3$ dual-phase region, to an $Ac_3$ temperature, the sum of the volume fractions of tempered martensite, bainite, and ferrite is 50% or more.

It is preferable that a high-strength medium manganese steel forming member for warm stamping according to the present invention has a composition containing 3-10 wt % of manganese (Mn), 0.05-0.3 wt % of carbon (C), and 0.1-1.0 wt % of silicon (Si) as components thereof, with a balance being iron (Fe) and unavoidable impurities, or a composition further containing 0.001-0.1 wt % of niobium (Nb) as an additional component thereof in addition to the former composition, and, after austenitizing in a second temperature span from an $Ac_3$ temperature of a ferrite and austenite dual-phase region to a temperature higher than the $Ac_3$ temperature by 100° C., the volume fraction of martensite is 90% or more.

It is preferable that the yield strength of the high-strength medium manganese steel forming member according to the present invention is 1.0 GPa or higher, and the tensile strength thereof is 1.5 GPa or higher.

It is preferable that a method for manufacturing a high-strength medium manganese steel forming member for warm stamping according to the present invention includes: step S3 of preparing a hot-rolled steel sheet or cold-rolled steel sheet having a composition containing 3-10 wt % of manganese (Mn), 0.05-0.3 wt % of carbon (C), and 0.1-1.0 wt % of silicon (Si) as components thereof, with a balance being iron (Fe) and unavoidable impurities, or a composition further containing 0.001-0.1 wt % of niobium (Nb) as an additional component thereof in addition to the former composition; and step S4 of heating the hot-rolled steel sheet or cold-rolled steel sheet in a first temperature span from a temperature 150, at which a ratio between ferrite and austenite becomes 1:1 in an $Ac_1$-$Ac_3$ dual-phase region, to an $Ac_3$ temperature or in a second temperature span from an $Ac_3$ temperature to a temperature higher than the $Ac_3$ temperature by 100° C. and performing austenitizing while maintaining the hot-rolled steel sheet or cold-rolled steel sheet for a predetermined period of time.

It is preferable that the method according to the present invention further includes, before step S3, step S1 of producing the hot-rolled steel sheet by reheating a medium manganese steel slab having the composition at 1000-1200° C., which is a temperature span of an austenite single-phase region, for a predetermined period of time, performing hot finishing rolling at a temperature equal to or higher than the $Ac_3$ temperature and equal to or lower than 1000° C., and performing winding at an Ms temperature-the $Ac_3$ temperature.

It is preferable that the method according to the present invention further includes, after step S1 and before step S3, step S2 of producing the cold-rolled steel sheet by performing cold rolling at room temperature.

It is preferable that the method according to the present invention further includes, before step S3, step S3-1 of annealing the hot-rolled steel sheet or cold-rolled steel sheet.

It is preferable that the method according to the present invention further includes, after the austenitizing, step S5-1 of performing warm stamping in the temperature span of step S4.

It is preferable that the method according to the present invention further includes, after the austenitizing, step S5-2 of performing warm stamping at a temperature lower than an austenitizing temperature by 10-300° C.

In the method according to the present invention, it is preferable that heating is performed up to the warm stamping temperature at a rate of 1-100° C./sec, maintenance is performed for 10-1000 seconds, press forming is performed, and then slow cooling is performed at a rate of 1-30° C./sec.

In the method according to the present invention, it is preferable that a martensite structure is obtained by performing slow cooling after the warm stamping.

Advantageous Effects

The high-strength medium manganese steel for warm stamping and the method for manufacturing the same according to the present invention have the following effects:

First, compared to the prior art boron-added steel for hot stamping, there is achieved the effect of being replaced with medium manganese steel containing 3-10 wt % of manganese (Mn) and 0.05-0.3 wt % of carbon (C). Furthermore, a small amount of Nb is added, and thus an effect is achieved in that strength is additionally improved.

Second, heat treatment is performed at the low austenitizing temperature of medium manganese steel, and thus an effect is achieved in that the high thermal energy consumption of the prior art hot stamping process is reduced.

Third, high strength is obtained by only slow cooling such as air cooling outside a mold without performing cooling at high rate inside the mold, and thus effects are achieved in that a process is simplified and manufacturing efficiency is improved.

The effects of the present invention are not limited to the effects mentioned above, and other effects not mentioned will be clearly understood by those skilled in the art from the following description.

BEST MODE

Figure 1:
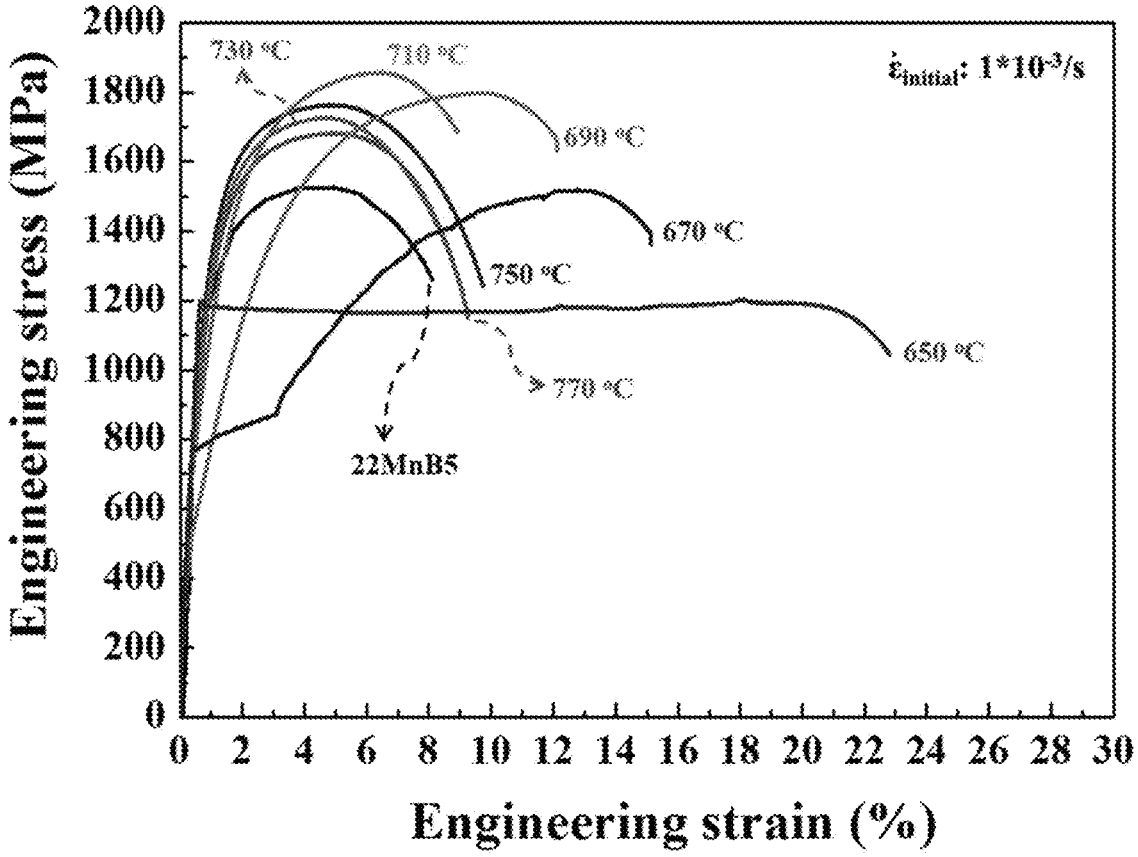
FIG. 1 is a graph showing the heat treatment temperature-based tensile properties of the specimen of Example 1 according to the present invention after cold rolling.

It is preferable that high-strength medium manganese steel for warm stamping according to the present invention contains 3-10 wt % of manganese (Mn), 0.05-0.3 wt % of carbon (C), and 0.1-1.0 wt % of silicon (Si) as components thereof, with the balance being iron (Fe) and unavoidably contained impurities.

MODE FOR INVENTION

Embodiments of the present invention will be described in detail below with reference to the accompanying drawings so that those having ordinary skill in the art to which the present invention pertains can readily practice the present invention. As those having ordinary skill in the art to which the present invention pertains can readily understand, the embodiments described below may be modified in various forms without departing from the concept and scope of the present invention. The same or similar parts are designated by the same reference symbols in the drawings as much as possible.

The terminology used herein is intended merely to refer to specific embodiments but is not intended to limit the present invention. The singular forms used herein include plural forms unless the passages clearly indicate the opposite.

The meaning of "including" or "comprising" used herein is intended to specify the presence of specific features, regions, integers, steps, actions, elements and/or components, but does not exclude the presence or addition of one or more other specific features, regions, integers, steps, actions, elements, components, and/or groups thereof.

All the terms, including technical terms and scientific terms, used herein have the same meanings as those generally understood by those having ordinary skill in the art to which the present invention pertains. The terms defined in dictionaries are additionally interpreted as having meanings consistent with the related technical literature and the present disclosure, and are not interpreted in an ideal or very formal sense unless defined.

In this specification, the contents of compositions will be described using percentage by weight (wt %).

The present specification provides (1) medium manganese-based alloy design, and (2) a manufacturing method that replaces the prior art hot stamping process. The present invention will be described in detail below.

(1) Medium Manganese-Based Alloy Design

The alloy of the present invention contains 3-10 wt % of Mn, 0.05-0.3 wt % of C, and 0.1-0.5 wt % of Si, with the balance being Fe and other unavoidable impurities. In order to further improve strength, the present invention contains 0.001-0.1 wt % of Nb, which is a small amount of trace alloying element. The steel sheet may further contain 0.001-5.0 wt % of one or more selected from the group consisting of Cr, Mo, Ni, Al, and Ti.

The reasons why the chemical composition range of the above-described steel is limited will be described below.

Manganese (Mn): 3-10 wt % Ferrite transformation is suppressed during cooling by improving the stability of austenite at high temperature through an Mn content of 3-10 wt %, thereby enabling a martensite structure to be obtained even in slow cooling. Furthermore, press forming temperature may be lowered by lowering Ac1-Ac3 dual-phase region temperature.

When the Mn content is less than 3 wt %, the stability of austenite is lowered, and thus ferrite is generated during cooling after hot rolling, so that a martensite-ferrite dual-phase structure may be formed at room temperature. In contrast, when the Mn content exceeds 10 wt %, problems may arise in that both raw material cost and manufacturing cost are increased, weldability is lowered, and manganese sulfide (MnS), which is a large amount of inclusion, is formed. Accordingly, in the present invention, it is preferable to limit the Mn content to 3-10 wt %.

Carbon C: 0.05-0.3 wt %

The stability of austenite may be secured at high temperature through a C content of 0.05-0.3 wt %, and carbon may be dissolved inside martensite at room temperature and improve strength.

When the C content is less than 0.05 wt %, the stability of austenite is lowered and thus ferrite may be generated during cooling, and the content of carbon dissolved inside martensite is lowered and thus strength may be lowered. In contrast, when the C content exceeds 0.3 wt %, cold rolling workability is lowered after hot rolling, so that strength may be insufficient and weldability may be deteriorated. Accordingly, in the present invention, it is preferable to limit the C content to 0.05-0.3 wt %.

Silicon (Si): 0.1-1.0 wt %

Although Si is a ferrite stabilizing element, it increases austenite hardenability at high temperature, and thus suppresses ferrite transformation during cooling. In addition, it functions to suppress the generation of carbides during cooling and to accelerate C segregation into austenite in a ferrite-austenite dual-phase section.

When the Si content is less than 0.1 wt %, the solid solution hardening effect of Si is reduced, and it becomes difficult for carbon to diffuse into austenite. In contrast, when the Si content exceeds 1.0 wt %, problems arise in that both raw material cost and manufacturing cost are increased and it is difficult to perform continuous casting, welding and plating. Accordingly, in the present invention, it is preferable to limit the Si content to 0.1-1.0 wt %.

Niobium (Nb): 0.001-0.1 wt %

Nb is an element that improves the strength of a steel sheet, grain refinement and heat treatment characteristics through a solid solution hardening effect and the precipitation of dissolved carbon. When the content of the element is less than 0.001 wt %, the amount of niobium carbide (NbC) to precipitate is small, and thus it is difficult to expect a strength improving effect. When the content of the element exceeds 0.1 wt %, manufacturing cost is excessively increased. Accordingly, it is preferable to limit the content to 0.001-0.1 wt %.

Aluminum (Al): 0001-5.0 wt %

Al is added as an element that improves the cleanness of steel and suppresses the generation of carbides through deoxidation action. As the amount of aluminum added increases, a dual-phase region expands, and thus uniform heat treatment may be performed. However, when the amount exceeds 5.0 wt %, dual-phase region temperature rises, and thus a problem arises in that the low austenitizing temperature of the present invention rises again. Furthermore, the stability of ferrite is increased, and thus ferrite may be present at room temperature after forming. Furthermore, the plating property of the steel sheet is deteriorated, and thus manufacturing cost is increased. Accordingly, in the present invention, it is preferable to limit the Al content to 0.001-5.0 wt %.

The sum of one or more of chromium (Cr), molybdenum (Mo), titanium (Ti), and nickel (Ni): 0.001-2.0 wt %

Cr, Mo, Ti, and Ni are elements that have the significant effect of further securing high strength through their hardenability and precipitation hardening effect. When the content is less than 0.001 wt %, it is difficult to expect sufficient hardenability and a sufficient precipitation hardening effect. In contrast, when the content exceeds 2.0 wt %, manufacturing cost increases. Accordingly, in the present invention, it is preferable to limit the content to 0.001-2.0 wt %.

(2) Manufacturing Method

A method for manufacturing niobium (Nb)-added medium manganese steel for warm stamping includes hot rolling and cold rolling conditions, a blank forming step, a blank heating and forming step, and a blank cooling step.

① Hot Rolling and Cold Rolling Conditions

After the dissolution of the alloy having the composition according to the present invention, a cast is homogenized at 1000-1400° C. for 12 hours for the uniform distribution of alloying elements inside steel. When the heating temperature is lower than 1000° C., the homogenization of a continuously cast structure is not sufficiently secured. In contrast, when it exceeds 1400° C., an increase in manufacturing cost occurs.

Thereafter, reheating is performed at 1000-1200° C., which corresponds to an austenite single-phase region, for 1 hour. When heating is performed, hot finishing rolling is performed at a temperature equal to or higher than an $Ac_3$ temperature, which is a critical transformation temperature, and equal to or lower than 1000° C. Thereafter, winding and slow cooling are performed at a temperature equal to or higher than $Ac_3$ and equal to or lower than an Ms temperature (the temperature from which the formation of martensite starts).

Figure 4:
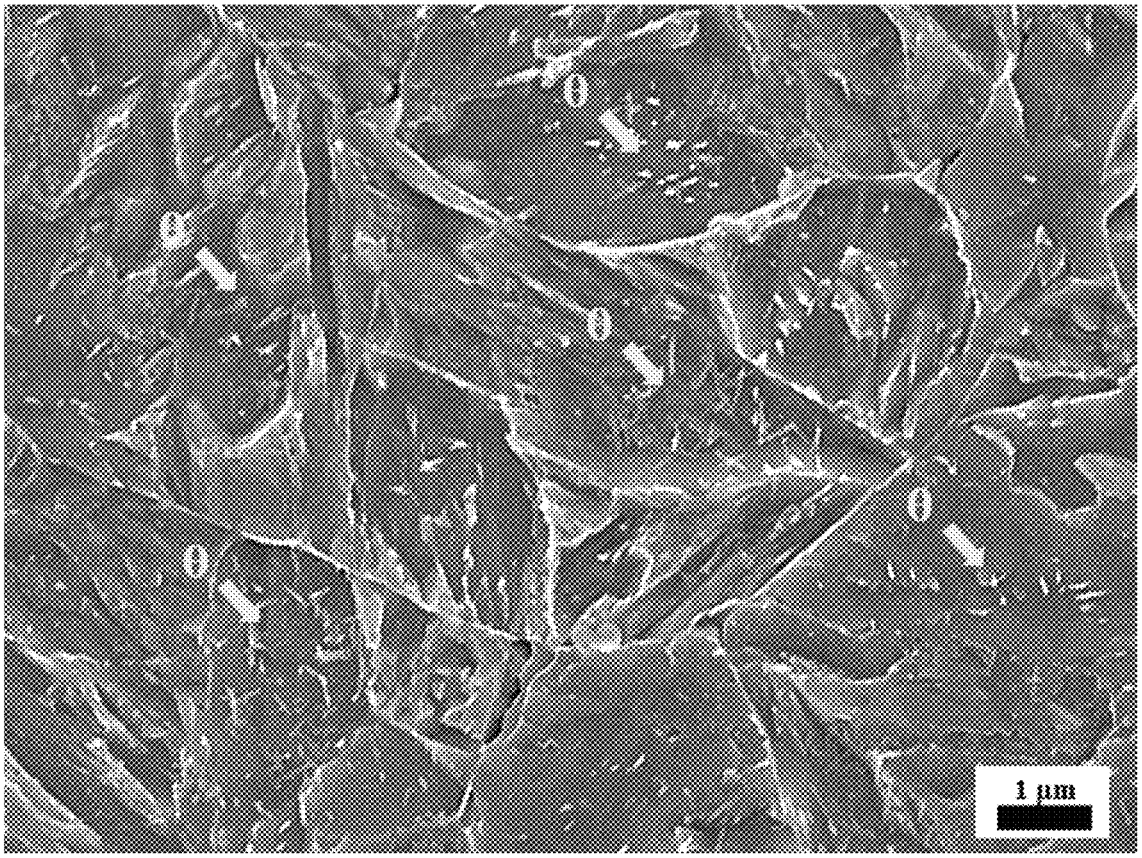
FIG. 4 is a photograph showing the microstructure of tempered martensite of Example 1 according to the present invention which is formed during slow cooling after hot rolling and winding.
Figure 5:
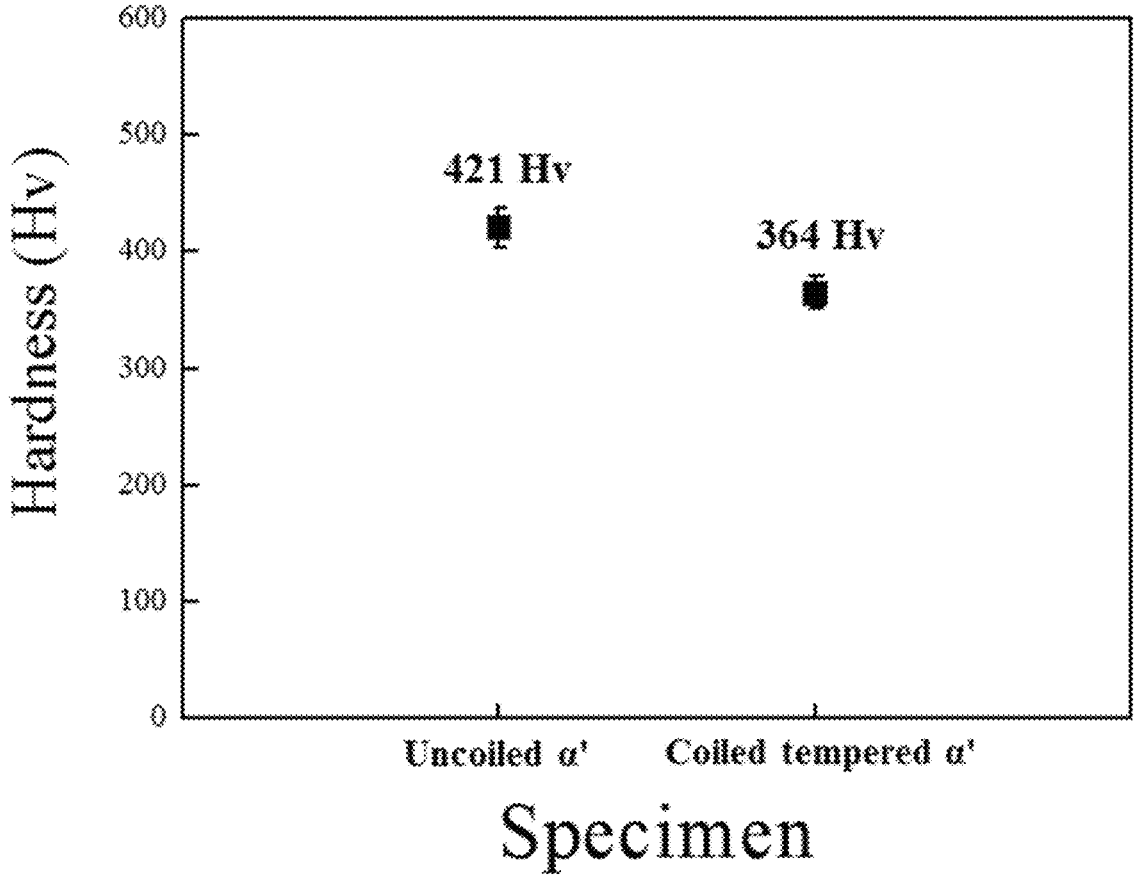
FIG. 5 is a graph showing the hardness values of Example 1 according to the present invention depending on whether or not winding is present after hot rolling.

During the slow cooling, austenite starts martensitic transformation as the temperature thereof passes the Ms temperature. At this time, martensite has a bct (body centered tetragonal) crystal structure, a large number of dislocations are formed therein, and carbon diffusion is accelerated. Accordingly, cementite is precipitated inside the martensite during the slow cooling. At room temperature, a final microstructure includes two phases of tempered martensite and bainite or three phases of tempered martensite, bainite and ferrite. In the case of the three phases, the volume fraction of the ferrite is preferably 10% or less (not including 0%). A photograph of a structure and hardness test results in the case of the three phases are shown in FIG. 4.

During austenitizing heat treatment, ferrite remains at a temperature equal to or lower than $Ac_3$, and thus final room-temperature strength decreases. Through the above process, a cold roll-ability may be improved by lowering the strength of a hot-rolled steel sheet.

Thereafter, the hot-rolled steel sheet may be additionally cold-rolled at room temperature to produce a cold-rolled steel sheet. Then the cold-rolled steel sheet may be subjected to annealing heat treatment at 550-750° C. for 1-5 minutes.

② Blank Forming Step

In the blank forming step, the steel sheet is cut into a blank. This blank is designed to fit the shape of a mold.

③ Blank Heating (Austenitizing) and Forming Step

In the blank heating step, the blank is subjected to heat treatment. A dual-phase region temperature span from the temperature $T_{50}$, at which the ratio between ferrite and austenite becomes 1:1 in an $Ac_1$-$Ac_3$ dual-phase region, to the $Ac_3$ temperature is referred to as a "first temperature span" in the present invention. Furthermore, the temperature range from the $Ac_3$ temperature to the temperature higher than the $Ac_3$ temperature by 100° C. is referred to as a "second temperature span" in the present invention. The blank is maintained for about 1-15 minutes after heating in the first or second temperature span. This process is called an austenitizing process (see FIGS. 7 to 10).

The heat treatment temperature was previously proposed as the $Ac_1$-$Ac_3$ dual-phase region temperature in Korean Patent Application Publication No. 10-2013-0050138. In this invention, although the forming temperature is low, strength comparable to that of hot-stamped steel was not secured. The reason for this is that sufficient austenite is not generated at the heat treatment temperature based on the composition and contents of the present invention, such as the essential inclusion of aluminum (Al), so that sufficient martensite is not generated during cooling after forming, thereby making it difficult to ensure target strength.

Accordingly, in the present invention, the first temperature span from the temperature $T_{50}$, at which the volume fraction between ferrite and austenite becomes 1:1 in the $Ac_1$-$Ac_3$ dual-phase region, to the $Ac_3$ temperature is targeted for high-strength steel having high elongation, and the second temperature span from the $Ac_3$ temperature to the temperature higher than the $Ac_3$ temperature by 100° C. is designated as an austenitizing temperature range targeted for ultra-high strength.

In the second temperature span, when the temperature is lower than $Ac_3$ temperature, ferrite is present in a final microstructure, resulting in low yield strength. When the temperature exceeds the temperature higher than the $Ac_3$ temperature by 100° C., there is concern that reverse-transformed austenite becomes coarse and thus strength is lowered, and thus it is similar to the austenitizing temperature of hot forming. Accordingly, manufacturing cost is increased again.

After the austenitizing process, the heated steel sheet is transferred to a mold and subjected to warm forming at the temperature lower than the austenitizing temperature by 10-300° C. When the heated steel sheet is transferred to the mold, it is inevitable that the temperature of the heated steel sheet falls by 10° C. or higher. When it falls by 300° C., the yield strength of the steel sheet increases, and thus a large load is applied to the mold during molding. This leads to a decrease in the lifespan of the mold and an increase in the manufacturing cost of the mold.

④ Blank Cooling Step

In the blank cooling step, the heated blank is transferred to a press mold and press-molded, and then the molded part is taken out from the press mold and cooled in air. In the prior art hot stamping process, rapid cooling inside a mold is required to obtain martensite. In contrast, the inventive steel may obtain a martensite structure even at a slow cooling rate such as that of air cooling.

The microstructure of the molded steel sheet has a martensite-bainite-ferrite-austenite multiphase structure. In the first temperature span, the sum of the volume fractions of martensite, bainite and ferrite is 50% or more. When the temperature is $T_{50}$, the stability of austenite is increased, and thus the volume fraction of austenite is 20% or more. In the second temperature span, the steel sheet has the volume fraction of martensite that is 90% or more.

The present invention will be described in more detail through examples below.

Example 1

Each steel slab having a composition shown in Table 1 was heated for 1 hour in a reheating temperature range of 1100-1250° C. and then hot-rolled. At this time, hot rolling was terminated at 900-1000° C., and air cooling was performed up to room temperature. The produced hot-rolled sheet was cold-rolled at a cold rolling thickness reduction percentage of 55% to produce a cold-rolled sheet.

The cold-rolled sheet produced as described above was used based on the simulation of the heat treatment conditions of a warm stamping process. Heat treatment was performed for 10 minutes while the temperature was varied within the range from the temperature $T_{50}$, at which the ratio between ferrite and austenite becomes 1:1 in the heat treatment dual-phase region, to an austenite single-phase region temperature higher than the $A_3$ temperature by 50° C., and air cooling was performed up to room temperature. In this case, the heating rate was 3° C./sec and the cooling rate was 10° C./sec.

TABLE 1

| Type of steel | Chemical components (wt %) C | Mn | Si | Nb | B | others | Dual-phase region temperature (° C.) $A_1$ | $A_3$ | Remarks |
|---|---|---|---|---|---|---|---|---|---|
| A | 0.15 | 5.9 | 0.38 | 0.05 | — | — | 610 | 715 | inventive steel |
| B | 0.16 | 5.15 | 0.37 | — | | | 625 | 735 | inventive steel |
| C | 0.093 | 7.22 | 0.49 | — | — | — | 580 | 700 | inventive steel |
| D | 0.22 | 1.29 | 0.28 | — | 0.003 | Ti: 0.039<br>Cr: 0.193<br>Ni: 0.013 | | | comparative steel (boron-added steel for hot stamping) |

Furthermore, as shown in Table 2, inventive steels A-1 to A-3 exhibited excellent room-temperature tensile properties when heat treatment was performed at the temperature higher than the $A_3$ temperature by about 10-50° C. or higher. In contrast, inventive steels A-4 to A-7 lower than the temperature $A_3$ did not meet yield strength and tensile strength (T. S.) required for alternative steel to hot-stamped steel. Inventive steel A-7 may be applied to parts requiring high yield strength and a high elongation index (EI). The tensile curve according to each heat treatment temperature for inventive steel A is shown in FIG. 1.

TABLE 2

| Type of steel | Heat treatment temperature (temperature actually applied to process) (° C.) | Yield strength (MPa) | Tensile strength (MPa) | Total elongation (%) | T.S.*El (MPa %) |
|---|---|---|---|---|---|
| A-1 | 770 | 1040 | 1680 | 9.3 | 15624 |
| A-2 | 750 | 1080 | 1765 | 9.7 | 17120 |
| A-3 | 730 | 1030 | 1725 | 9.1 | 15697 |
| A-4 | 710 | 870 | 1855 | 8.9 | 16509 |
| A-5 | 690 | 480 | 1800 | 12.1 | 21780 |
| A-6 | 670 | 775 | 1515 | 15.1 | 22876 |
| A-7 | 650 | 1180 | 1200 | 22.8 | 27360 |
| D | 900 | 1000 | 1500 | 8 | 12000 |

Figure 2:
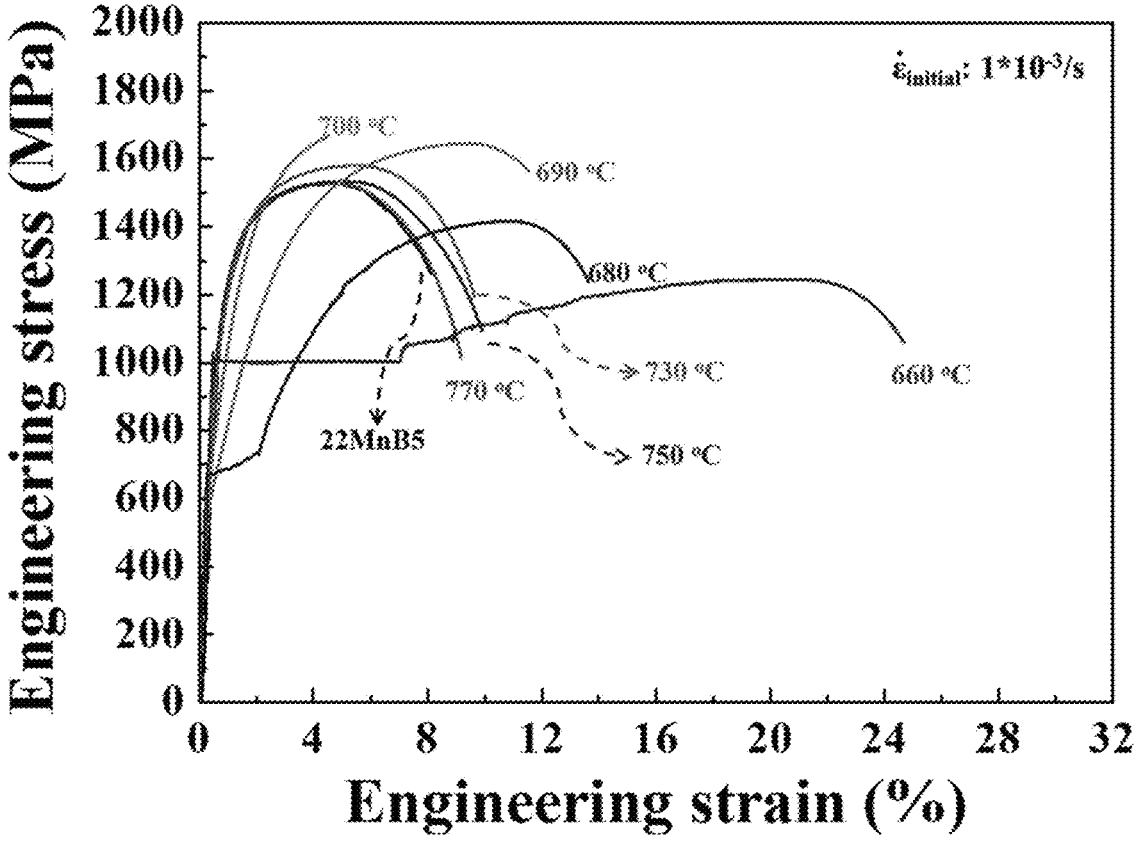
FIG. 2 is a graph showing the heat treatment temperature-based tensile properties of the specimen of Example 1 according to the present invention after cold rolling and annealing.
Figure 3:
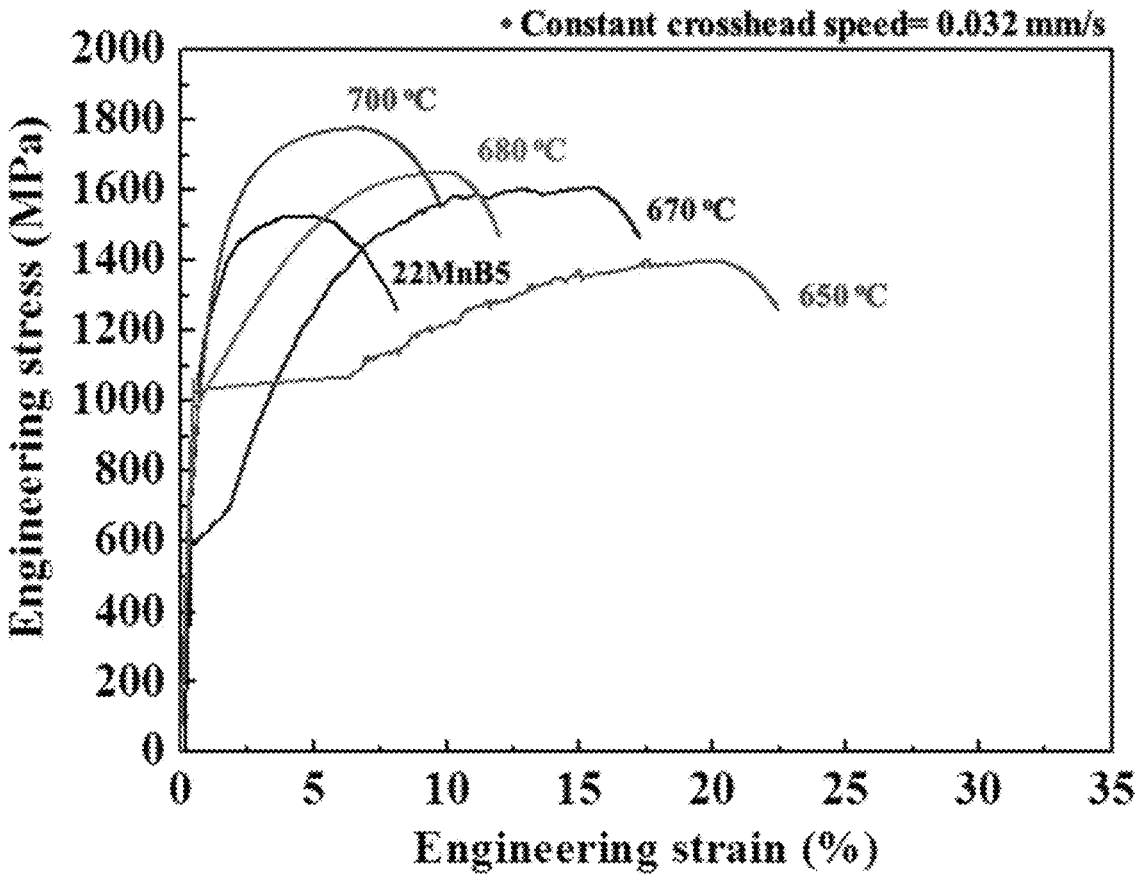
FIG. 3 is a graph showing the heat treatment temperature-based tensile properties of the specimen of Example 2 according to the present invention after cold rolling.

The mechanical properties are shown in Tables 3 and 4 after warm stamping simulation heat treatment using medium manganese steel not added with Nb. Inventive steels B and C exhibited excellent physical properties when austenitizing heat treatment was performed at the $A_3$ temperature or higher. The tensile curves of inventive steels B and C according to respective heat treatment temperatures are shown in FIGS. 2 and 3. The austenite fractions of final microstructures at room temperature after air cooling according to temperature are shown in Table 5 below. As the temperature decreased, the stability of the reverse-transformed austenite increased, and thus the fraction of retained austenite increased. Inventive steel A-3 heat-treated at a temperature equal to or higher than the $A_3$ temperature did not contain retained austenite, which indicated that all of the reverse-transformed austenite was transformed to martensite. Accordingly, room-temperature yield strength and tensile strength were excellent.

When inventive steels A and B are compared with each other, it is determined that the yield strength and tensile strength of inventive steel A were higher than those of inventive steel B at the same heat treatment temperature. It can be seen that strengths were improved due to solid solution hardening and precipitation hardening by adding Nb.

TABLE 3

| Type of steel | Heat treatment temperature (temperature actually applied to process) (° C.) | Yield strength (MPa) | Tensile strength (MPa) | Total elongation (%) | T.S.*El (MPa %) |
|---|---|---|---|---|---|
| B-1 | 770 | 1045 | 1530 | 9.2 | 14076 |
| B-2 | 750 | 1040 | 1535 | 10 | 15350 |
| B-3 | 730 | 1000 | 1580 | 9.6 | 15168 |
| B-4 | 700 | 770 | 1660 | 4.5 | 7470 |
| B-5 | 690 | 620 | 1640 | 11.5 | 18860 |
| B-6 | 680 | 670 | 1410 | 13.5 | 19035 |
| B-7 | 660 | 1000 | 1240 | 24.5 | 30380 |
| D | 900 | 1000 | 1500 | 8 | 12,000 |

TABLE 4

| Type of steel | Heat treatment temperature (temperature actually applied to process) (° C.) | Yield strength (MPa) | Tensile strength (MPa) | Total elongation (%) | T.S.*El (MPa %) |
|---|---|---|---|---|---|
| C-1 | 700 | 1000 | 1775 | 10 | 17,750 |
| C-2 | 680 | 1000 | 1650 | 12 | 19,800 |
| C-3 | 670 | 600 | 1580 | 17 | 26,860 |
| C-4 | 650 | 1020 | 1400 | 23 | 32,200 |
| D | 900 | 1000 | 1500 | 8 | 12,000 |

TABLE 5

| Type of steel | Residual austenite volume fraction (%) |
|---|---|
| A-3 | 0 |
| A-4 | 10 |
| A-5 | 32 |
| A-6 | 38 |

Example 2

In Example 1, cold-rolled inventive steel A was additionally subjected to annealing heat treatment CA. Heat treatment conditions were 650-750° C. and 3 minutes, and heat treatment was performed while the temperature was varied. The cold-rolled annealed steel sheet was treated, with the heat treatment conditions of a warm stamping process subdivided into austenitizing temperature $T_A$ and forming temperature $T_s$. The austenitizing temperature was 650-750° C. for 5 minutes, the molding temperature was 650-750° C. for 1 minute, and the treatment was performed while the temperature was varied. After the heat treatment, air cooling was performed up to room temperature. In this case, the heating rate was 3° C./sec and the cooling rate was 10° C./sec.

TABLE 6

| Type of | Heat treatment temperature (° C.) | | | Yield strength | Tensile strength | Total elongation |
|---|---|---|---|---|---|---|
| steel | CA | $T_A$ | $T_S$ | (MPa) | (MPa) | (%) |
| A-8 | 750 | 750 | 700 | 1085 | 1810 | 11.6 |
| A-9 | | | 650 | 1070 | 1820 | 11.6 |
| A-10 | | | 600 | 1040 | 1740 | 10.2 |
| A-11 | | | 550 | 1065 | 1780 | 11.2 |
| A-12 | | 700 | 650 | 530 | 1630 | 14.0 |
| A-13 | | | 600 | 510 | 1650 | 16.5 |
| A-14 | | | 550 | 500 | 1630 | 14.6 |
| A-15 | | 650 | 600 | 950 | 1210 | 32.1 |
| A-16 | | | 550 | 980 | 1160 | 32.5 |
| A-17 | | | 500 | 970 | 1180 | 32.7 |
| A-18 | 700 | 750 | 700 | 1090 | 1780 | 11.4 |
| A-19 | | | 650 | 1010 | 1720 | 10.8 |
| A-20 | | | 600 | 1000 | 1690 | 10.0 |
| A-21 | | | 550 | 1040 | 1760 | 10.6 |
| A-22 | | | 650 | 350 | 1640 | 14.3 |
| A-23 | | 700 | 600 | 360 | 1670 | 14.1 |
| A-24 | | | 550 | 370 | 1650 | 14.4 |
| A-25 | | | 600 | 1050 | 1350 | 22.7 |
| A-26 | | 650 | 550 | 1030 | 1330 | 22.4 |
| A-27 | | | 500 | 1080 | 1380 | 22.8 |
| A-28 | 650 | 750 | 700 | 1040 | 1750 | 11.7 |
| A-29 | | | 650 | 1065 | 1800 | 10.4 |
| A-30 | | | 600 | 1010 | 1760 | 10.3 |
| A-31 | | | 550 | 1060 | 1780 | 10.3 |
| A-32 | | 700 | 650 | 500 | 1710 | 8.2 |
| A-33 | | | 600 | 350 | 1680 | 14.8 |
| A-34 | | | 550 | 340 | 1740 | 14.2 |
| A-35 | | 650 | 600 | 1155 | 1280 | 21.2 |
| A-36 | | | 550 | 1180 | 1260 | 22.6 |
| A-37 | | | 500 | 1175 | 1260 | 22.0 |

Furthermore, as shown in Table 6, it was confirmed that the annealing temperature CA and the molding temperature $T_s$ did not significantly affect room-temperature tensile properties. Like in Example 1, the austenitizing temperature $T_S$ acted significantly. Inventive steels A-8 to A-11, A-18 to A-21, and A-28 to A-31 all exhibited better properties than hot-stamped steel. At other low $T_A$, target room-temperature tensile property values were not reached.

Example 3

In Example 3, unlike in Examples 1 and 2, inventive steel A was processed into a hot-rolled steel sheet without cold rolling. Inventive steels A-38 and A-39 were subjected to annealing heat treatment at 750° C. for 3 minutes. Thereafter, the steel sheet was processed, with the heat treatment conditions of a warm stamping process subdivided into austenitizing temperature $T_A$ and molding temperature $T_S$. The austenitizing temperature was 650-750° C. for 5 minutes, the molding temperature was 600° C. for 1 minute, and the treatment was performed while the temperature was varied. After the heat treatment, air cooling was performed up to room temperature. In this case, the heating rate was 3° C./sec, and the cooling rate was 10° C./sec.

TABLE 7

| Type of | Heat treatment temperature (° C.) | | | Yield strength | Tensile strength | Total elongation |
|---|---|---|---|---|---|---|
| steel | CA | $T_A$ | $T_S$ | (MPa) | (MPa) | (%) |
| A-38 | X | 750 | 600 | 1025 | 1630 | 10.3 |
| A-39 | | 650 | | 950 | 1100 | 23.3 |
| A-40 | 750 | 750 | | 1050 | 1670 | 7.4 |
| A-41 | | 650 | | 900 | 1150 | 25.4 |

As shown in Table 7, it was confirmed that the annealing temperature CA and the molding temperature $T_s$ did not significantly affect room-temperature tensile properties. Like in Examples 1 and 2, the austenitizing temperature $T_A$ acted significantly. Inventive steels A-38 and A-40 all exhibited better properties than hot-stamped steel. At other low $T_A$, target room-temperature tensile property values were not reached. Through the above example, it was confirmed that only a hot-rolled steel sheet may be applied as a warm-stamped steel sheet, replacing a hot-stamped steel sheet, without requiring a cold rolling process.

Various embodiments of a method for manufacturing a high-strength medium manganese steel forming member for warm stamping according to the present invention will be described below.

Figure 6:
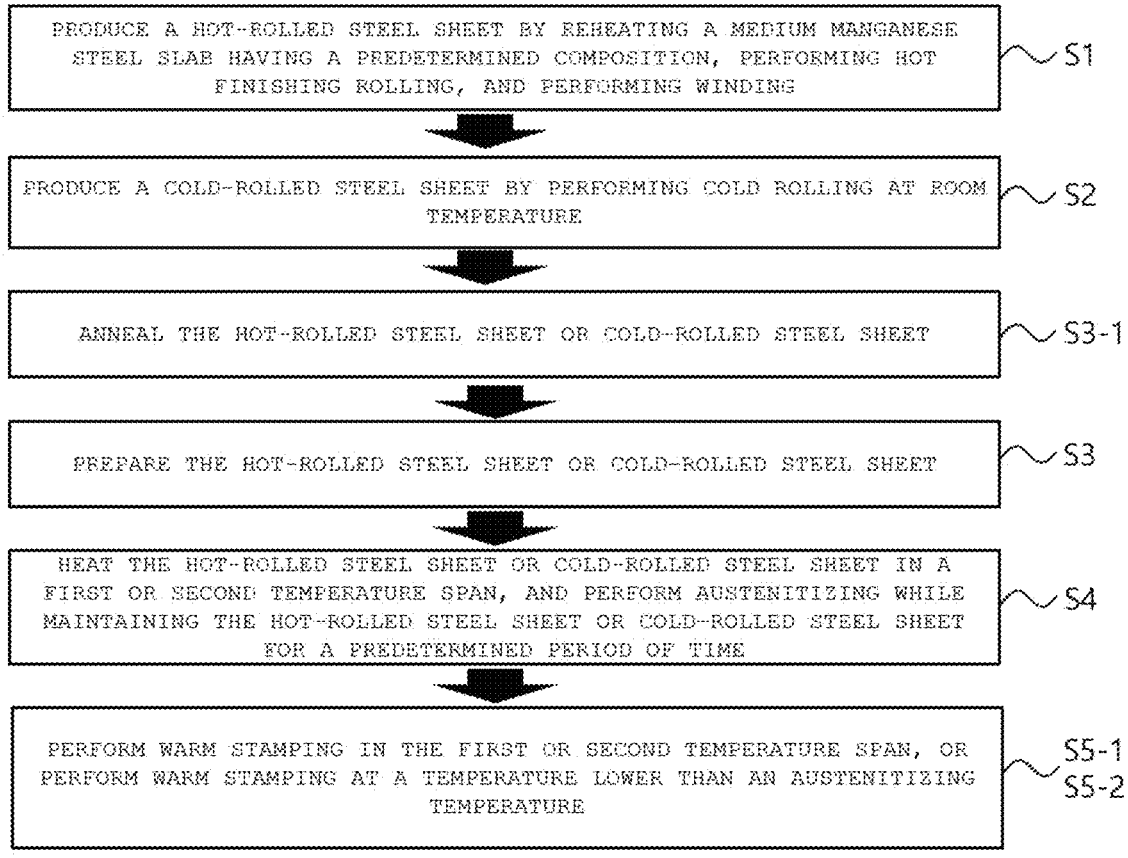
FIG. 6 shows one method for manufacturing a high-strength medium manganese steel forming member for warm stamping according to the present invention.

FIG. 6 shows a method for manufacturing a high-strength medium manganese steel forming member for warm stamping according to the present invention. The manufacturing method according to the present invention includes at least steps S3 and S4.

Step S3 according to the present invention is the step of preparing a hot-rolled steel sheet or cold-rolled steel sheet having a composition containing 3-10 wt % of manganese (Mn), 0.05-0.3 wt % of carbon (C), and 0.1-1.0 wt % of silicon (Si) as components thereof, with the balance being iron (Fe) and unavoidable impurities, or a composition further containing 0.001-0.1 wt % of niobium (Nb) as an additional component thereof in addition to the former composition. All the compositions according to the present invention may be applied to step S3.

Furthermore, a cold-rolled steel sheet subjected to hot rolling and cold rolling may be applied, or a hot-rolled steel sheet subjected to only hot rolling may be applied.

In step S1 according to the present invention, a hot-rolled steel sheet may be produced by reheating a medium manganese steel slab having the above-described composition at 1000-1200° C., which is the temperature span of an austenite single-phase region, for a predetermined period of time, performing hot finishing rolling at a temperature equal to or higher than the $Ac_3$ temperature and equal to or lower than 1000° C., and performing winding at the Ms temperature-the $Ac_3$ temperature.

In step S2 according to the present invention, a cold-rolled steel sheet may be produced by performing cold rolling at room temperature.

The present invention may further include step S3-1 of annealing the hot-rolled steel sheet or cold-rolled steel sheet.

In step S4 according to the present invention, the hot-rolled steel sheet or cold-rolled steel sheet may be heated in the first temperature span from the temperature 150, at which the ratio of ferrite and austenite becomes 1:1 in the $Ac_1$-$Ac_3$ dual-phase region, to the $Ac_3$ temperature or in the second temperature span from the $Ac_3$ temperature to the temperature higher by 100° C., and then austenitizing may be performed while maintaining the hot-rolled steel sheet or cold-rolled steel sheet for a predetermined period of time.

Figure 7:
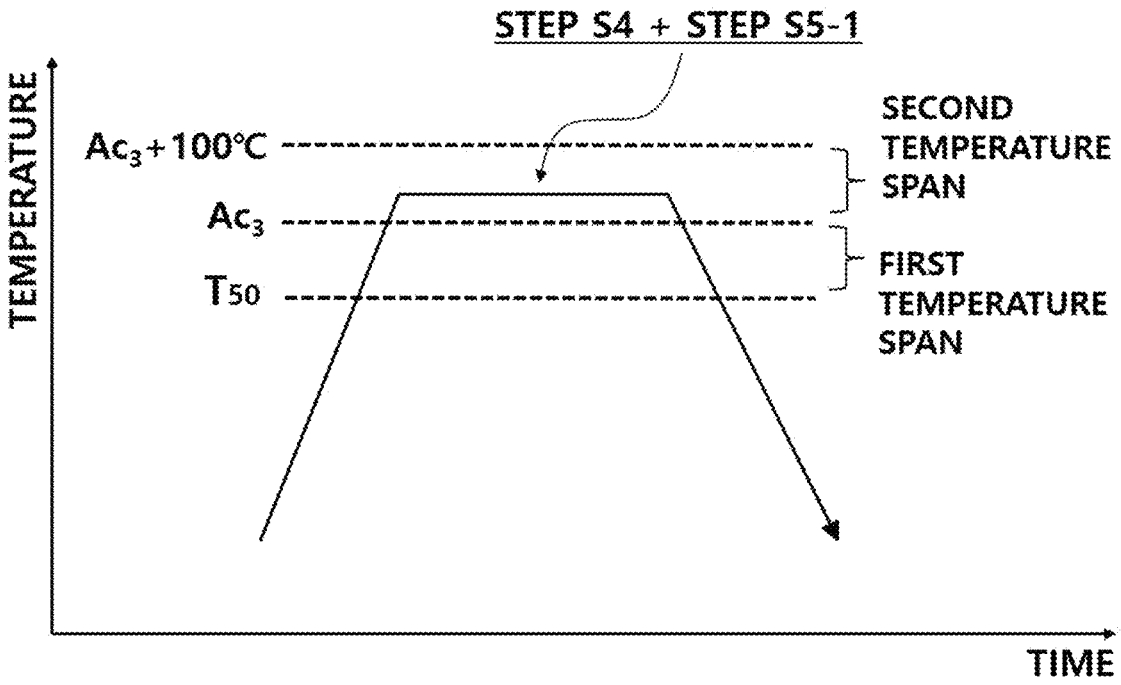
FIGS. 7 to 10 show various embodiments of austenitizing and warm stamping according to the present invention.
Figure 8:
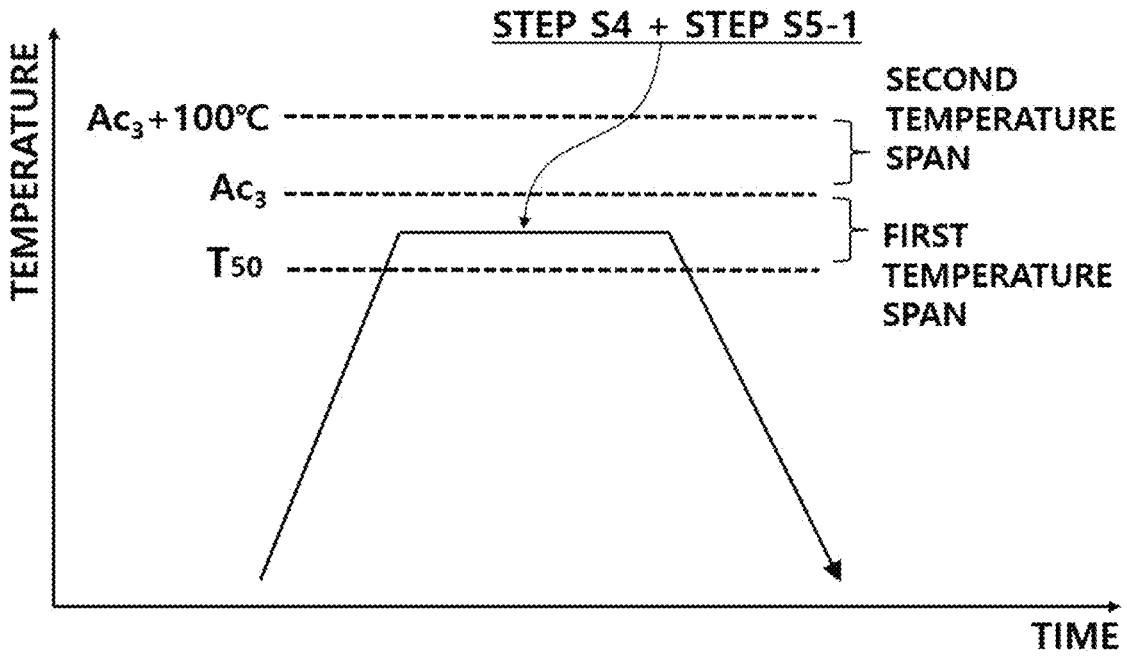

The present invention may include step S5-1 of performing warm stamping in the temperature span of step S4 after the austenitizing. FIG. 7 shows the performance of steps S4 and S5-1 in the second temperature span, and FIG. 8 shows the performance of steps S4 and S5-1 in the second temperature span.

Figure 9:
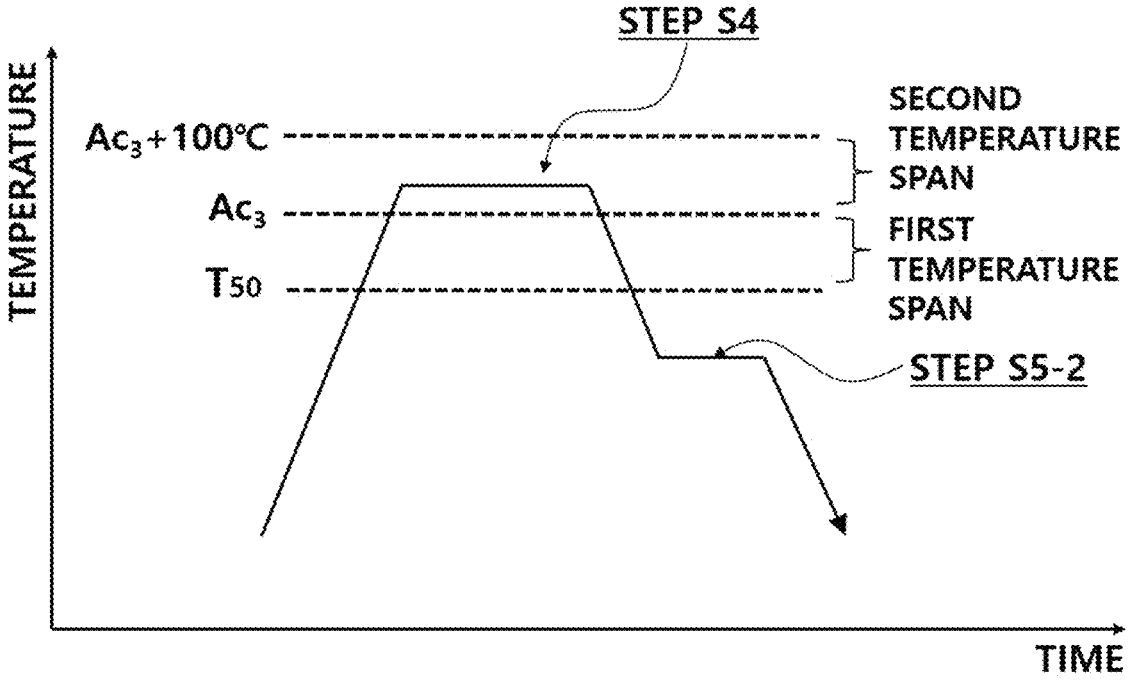
Figure 10:
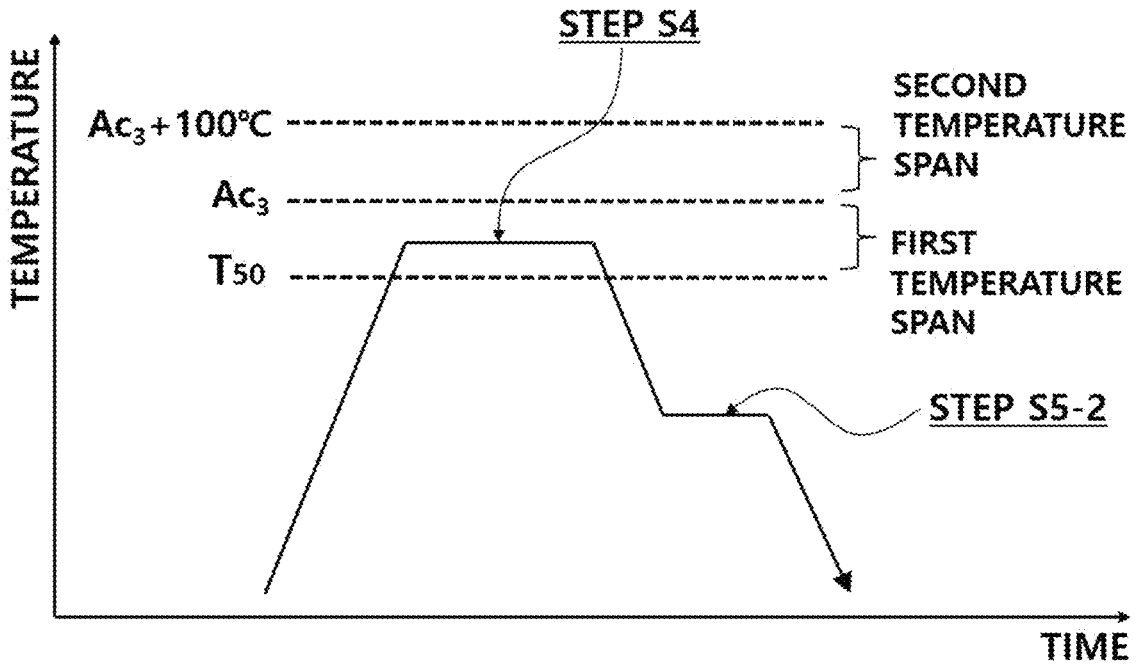

The present invention may include, after the austenitizing, step S5-2 of performing warm stamping at the temperature lower than the austenitizing temperature by 10-300° C. FIG. 9 shows the performance of step S4 in the first temperature span and the performance of step S5-2 in a lower temperature span, and FIG. 10 shows the performance of step S4 in the first temperature span and the performance of step S5-2 in a low temperature span.

In addition, in the present invention, a martensite structure may be obtained by performing slow cooling such as air cooling after warm stamping.

The possible main embodiments of the manufacturing method according to the present invention are shown in Table 8 below, but are not limited to the embodiments presented in Table 8.

TABLE 8

| |
|---|
| S1 –> S2 –> S3-1 –> S3 –> S4 –> (S5-1 or S5-2) |
| S1 -------> S3-1 –> S3 –> S4 –> (S5-1 or S5-2) |
| S1 ----------> S3 –> S4 –> (S5-1 or S5-2) |
| S2 –> S3-1 –> S3 –> S4 –> (S5-1 or S5-2) |
| S2 ---------> S3 –> S4 –> (S5-1 or S5-2) |
| S1 –> S2 ---------> S3 –> S4 –> (S5-1 or S5-2) |

The embodiments described in the present specification and the accompanying drawings are merely illustrative of some of the technical spirit included in the present invention. Accordingly, the embodiments disclosed in the present specification are not intended to limit the technical spirit of the present invention but are intended to describe it. Therefore, it will be apparent that the scope of the technical spirit of the present invention is not limited by these embodiments. The modifications and specific embodiments that can be easily inferred by those skilled in the art within the scope of the technical spirit included in the specification and drawings of the present invention should be interpreted as being included in the scope of the present invention.

The invention claimed is:

1. A method for manufacturing a medium manganese steel forming member for warm stamping, the method comprising:

step S3 of preparing a hot-rolled steel sheet or cold-rolled steel sheet having a composition containing 3-10 wt % of manganese (Mn), 0.05-0.3 wt % of carbon (C), and 0.1-1.0 wt % of silicon (Si) as components thereof, with a balance being iron (Fe) and unavoidable impurities, or a composition further containing 0.001-0.1 wt % of niobium (Nb) as an additional component thereof in addition to the former composition;

step S4 of heating the hot-rolled steel sheet or cold-rolled steel sheet in a temperature span from a temperature higher than an $Ac_3$ temperature to 745° C. and performing austenitizing while maintaining the hot-rolled steel sheet or cold-rolled steel sheet for 1-15 minutes; and after the austenitizing, step S5-2 of performing warm stamping at 500-650° C.

2. The method of claim 1, further comprising, before step S3:

step S1 of producing the hot-rolled steel sheet by reheating a medium manganese steel slab having the composition at 1000-1200° C., which is a temperature span of an austenite single-phase region, for 1 hour, performing hot finishing rolling at a temperature equal to or higher than the $Ac_3$ temperature and equal to or lower than 1000° C., and performing winding at an Ms temperature-the $Ac_3$ temperature.

3. The method of claim 2, further comprising, after step S1 and before step S3:

step S2 of producing the cold-rolled steel sheet by performing cold rolling at room temperature.

4. The method of claim 3, further comprising, before step S3:

step S3-1 of annealing the hot-rolled steel sheet or cold-rolled steel sheet.

5. The method of claim 2, further comprising, before step S3:

step S3-1 of annealing the hot-rolled steel sheet or cold-rolled steel sheet.

6. The method of claim 1, wherein heating is performed up to the warm stamping temperature at a rate of 1-100° C./sec, maintenance is performed for 10-1000 seconds, press forming is performed, and then slow cooling is performed at a rate of 1-30° C./sec.

7. The method of claim 6, wherein a martensite structure is obtained by performing slow cooling after the warm stamping.

* * * * *